US010697237B1

(12) United States Patent
Carpenter

(10) Patent No.: US 10,697,237 B1
(45) Date of Patent: Jun. 30, 2020

(54) TURNTABLE BETWEEN SECURED AND UNSECURED AREAS

(71) Applicant: Thomas P. Carpenter, Westerly, RI (US)

(72) Inventor: Thomas P. Carpenter, Westerly, RI (US)

( * ) Notice: Subject to any disclaimer, the term of this patent is extended or adjusted under 35 U.S.C. 154(b) by 48 days.

(21) Appl. No.: 16/191,538

(22) Filed: Nov. 15, 2018

Related U.S. Application Data

(60) Provisional application No. 62/598,668, filed on Dec. 14, 2017.

(51) Int. Cl.
*E06B 11/08* (2006.01)
*A47G 29/22* (2006.01)
*E06B 3/90* (2006.01)

(52) U.S. Cl.
CPC ..... *E06B 11/08* (2013.01); *A47G 29/22* (2013.01); *E06B 3/90* (2013.01); *E05Y 2400/86* (2013.01); *E05Y 2800/426* (2013.01); *E05Y 2900/11* (2013.01); *E05Y 2900/602* (2013.01)

(58) Field of Classification Search
CPC . A47G 29/22; E06B 3/90; E06B 11/08; E06B 7/32; E05Y 2400/86; E05Y 2800/426; E05Y 2900/11; E05Y 2900/602; E05G 7/007; E05G 5/02
USPC ..... 232/43.3, 43.4, 44; 109/19, 68; 49/68, 49/42, 46
See application file for complete search history.

(56) References Cited

U.S. PATENT DOCUMENTS 1,669,539 A * 5/1928 Smart ..... E05G 7/007 109/19
2,846,287 A * 8/1958 Gardner ..... E06B 3/385 312/272.5
3,055,319 A * 9/1962 Asprion ..... E05G 7/007 109/12
3,474,745 A * 10/1969 Schlaefli ..... E05G 7/007 109/19
3,696,805 A 10/1972 Sweeten et al.
3,702,101 A * 11/1972 Moore ..... E05G 7/007 109/19
4,084,518 A * 4/1978 Carlson ..... E06B 7/32 109/19
4,121,523 A * 10/1978 Hastings ..... E05G 5/02 109/11
4,158,999 A * 6/1979 Sukolics ..... E05G 7/007 109/19
4,351,247 A * 9/1982 Clark ..... E06B 7/32 109/11

(Continued)

*Primary Examiner* — William L Miller
(74) *Attorney, Agent, or Firm* — Salter & Michaelson

(57) ABSTRACT

A turntable system for use between a secured area and an unsecured area of a facility in which the turntable system includes a turntable having a base and interior support area, an input door connected to the turntable at the secured area where items can be loaded through the input door and an output door connected to the turntable at the unsecured area and at a location disposed away from the input door where the items are received via said output door at the unsecured area. The turntable system further includes at least one blocking wall that is disposed within the interior support area of the turntable and, at least a portion of which, is moveable out of the way as the base of the turntable is rotated in delivering the items from the input door to the output door.

20 Claims, 12 Drawing Sheets

(56) References Cited

U.S. PATENT DOCUMENTS

| | | | | | |
|---|---|---|---|---|---|
| 4,773,338 | A * | 9/1988 | Hastings | E05G 5/02 | 109/11 |
| 5,400,550 | A | 3/1995 | Beasley | | |
| 5,815,987 | A | 10/1998 | Beasley | | |
| 5,921,191 | A * | 7/1999 | Gabel | E05G 7/005 | 109/13 |
| 6,148,568 | A | 11/2000 | Beasley | | |
| 6,378,769 | B1 * | 4/2002 | Wolgamot | E06B 7/32 | 109/68 |
| 6,588,655 | B2 * | 7/2003 | Stapleton, Jr. | E06B 7/32 | 109/68 |
| 6,598,546 | B2 * | 7/2003 | Alexander | E06B 7/28 | 109/67 |
| 6,651,876 | B2 * | 11/2003 | Scott | E05B 65/0841 | 109/67 |
| 6,748,879 | B2 * | 6/2004 | Ehrmann | G07F 11/24 | 109/13 |
| 6,996,940 | B2 | 2/2006 | Beasley | | |
| 7,040,836 | B2 | 5/2006 | Rogers et al. | | |
| 7,104,721 | B2 | 9/2006 | Rogers et al. | | |
| 9,016,558 | B2 * | 4/2015 | Alexander | E06B 7/32 | 109/67 |
| 9,963,930 | B1 * | 5/2018 | Reisender | E06B 7/32 | |
| 10,140,602 | B2 * | 11/2018 | Kelly | G06Q 20/202 | |
| 10,238,210 | B1 * | 3/2019 | Shoenfeld | A47B 67/02 | |
| 10,487,571 | B2 * | 11/2019 | Humma | E05B 65/0888 | |
| 10,549,926 | B2 * | 2/2020 | Cano Coscia | E05G 7/008 | |
| 2015/0179025 | A1 * | 6/2015 | Cowell | E05G 7/00 | 109/10 |

* cited by examiner

TURNTABLE BETWEEN SECURED AND UNSECURED AREAS

RELATED CASES

Priority for this application is hereby claimed under 35 U.S.C. § 119(e) to commonly owned and U.S. Provisional Patent Application No. 62/598,668 which was filed on Dec. 14, 2017 and which is incorporated by reference herein in its entirety.

FIELD OF THE INVENTION

The present invention relates in general to a turntable that is used between secured and unsecured areas. More particularly, the present invention relates to a turntable system that is for ordering and delivering food products from a secured area to an unsecured area.

BACKGROUND OF THE INVENTION

There are facilities particularly at airports where food vendors are arranged in both secured and unsecured areas. In one circumstance, the food supply is arranged in a secured area and as such, is unable to deliver food products to an unsecured area.

Accordingly, it is an object of the concept of the present invention to provide a turntable which is essentially arranged at a separation wall between the secured and unsecured areas and that enables food products to be ordered at the unsecured side and delivered, via the turntable, from the secured area to the unsecured area.

Another object of the present invention is to provide a turntable as in the previous object and in which there may be provided some type of a communication at the unsecured area for ordering the product which will be delivered via the turntable.

SUMMARY OF THE INVENTION

To accomplish the foregoing and other objects, features and advantages of the present invention there is provided a turntable system for use between a secured area and an unsecured area of a facility in which the turntable system is comprised of a turntable having a base and interior support area, an input door connected to the turntable at the secured area where items can be loaded through the input door and an output door connected to the turntable at the unsecured area and at a location disposed away from the input door where the items are received via said output door at the unsecured area. The turntable system further includes at least one blocking wall that is disposed within the interior support area of the turntable and, at least a portion of which, is moveable out of the way as the base of the turntable is rotated in delivering the items from the input door to the output door.

In accordance with other aspects of the present invention the turntable also includes a top that has a slot for receiving the at least one blocking wall to enable the blocking wall to selectively block and unblock the interior support area of the turntable in order to provide protection against unauthorized access to the secured area; there may be provided multiple blocking walls disposed within the interior support area of the turntable; wherein one of the blocking walls is in a fixed position and another of the blocking walls is movable between blocked and unblocked positions; including an input device at the unsecured area used to make a request for the purchase of the item, a controller for directing the request from the input device to the secured area, a second input device at the secured area to instruct the controller to rotate the base in delivering the items from the input door to the output door; and wherein each of the input door and the output door has a closed position, and wherein the controller operates the rotation of the turntable base only when both of the input and output doors is closed.

In accordance with another version of the present invention there is provided a turntable system for use between a secured area and an unsecured area of a facility in which the turntable system is adapted to transfer an item in a secure manner from the secured area to the unsecured area. The turntable system is comprised of:

a turntable having a base and interior annular support area;

an input door connected to the turntable at the secured area where the item can be loaded through the input door, and having open and closed positions;

an output door connected to the turntable at the unsecured area and at a location opposite the input door where the items are received via said output door at the unsecured area, and having open and closed positions;

at least one blocking wall that is disposed within the interior support area of the turntable and having blocked and unblocked positions;

and a controller for controlling a rotation of the base in delivering the item from the input door to the output door;

said controller further adapted to control the at least one blocking wall to be in the unblocked position only when both of the input and output doors is in the closed position.

In accordance with still other aspects of the present invention the turntable also includes a top that has a slot for receiving the at least one blocking wall to enable the blocking wall to selectively block and unblock the interior support area of the turntable; including a first input device at the unsecured area used to make a request for the purchase of the item, said controller for directing the request from the input device to the secured area, a second input device at the secured area to instruct the controller to rotate the base in delivering the items from the input door to the output door; wherein the first input device comprises a touch pad at which one can order an item, and the second input device comprises an actuation button or switch that initiates the rotation of the base of the turntable; wherein the rotation of the base of the turntable occurs only when both the second input device is operated and both of the input and output doors are closed; wherein the controller allows the rotation of the base of the turntable to occur only when the at least one blocking wall is in the unblocked position; wherein there are provided multiple blocking walls disposed within the interior support area of the turntable; and wherein one of the blocking walls is in a fixed position and another of the blocking walls is movable between blocked and unblocked positions.

In accordance with still another version of the present invention there is provided a method of controlling a turntable system for use between a secured area and an unsecured area of a facility in which the turntable system is adapted to transfer an item in a secure manner from the secured area to the unsecured area. The method of controlling a turntable system is comprised of:

providing a turntable having a base and interior annular support area;

disposing an input door connected to the turntable at the secured area where the item can be loaded through the input door, and having open and closed positions;

disposing an output door connected to the turntable at the unsecured area and at a location opposite the input door where the items are received via said output door at the unsecured area, and having open and closed positions;

providing at least one blocking wall that is disposed within the interior support area of the turntable and having blocked and unblocked positions;

and controlling a rotation of the base in delivering the item from the input door to the output door by controlling the at least one blocking wall to be in the unblocked position only when both of the input and output doors are in their respective closed positions.

In accordance with still other aspects of the present invention the turntable also includes a top that has a slot for receiving the at least one blocking wall to enable the blocking wall to selectively block and unblock the interior support area of the turntable; including providing a first input device at the unsecured area used to make a request for the purchase of the item, said controller directing the request from the input device to the secured area, providing a second input device at the secured area to instruct the controller to rotate the base in delivering the items from the input door to the output door; including providing the first input device as a touch pad at which one can order an item, and providing the second input device as an actuation button or switch that initiates the rotation of the base of the turntable; wherein the rotation of the base of the turntable occurs only when both the second input device is operated and both of the input and output doors are closed; and wherein the controller allows the rotation of the base of the turntable to occur only when the at least one blocking wall is in the unblocked position.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

The drawings illustrate the turntable T as arranged between opposed position windows or doors D. Each of these windows is a structure that enables access to the turntable. On the input side where food is loaded, the door can be either open or closed. Likewise, on the delivery side of the turntable the door D can also be either opened or closed.

Figure 1:
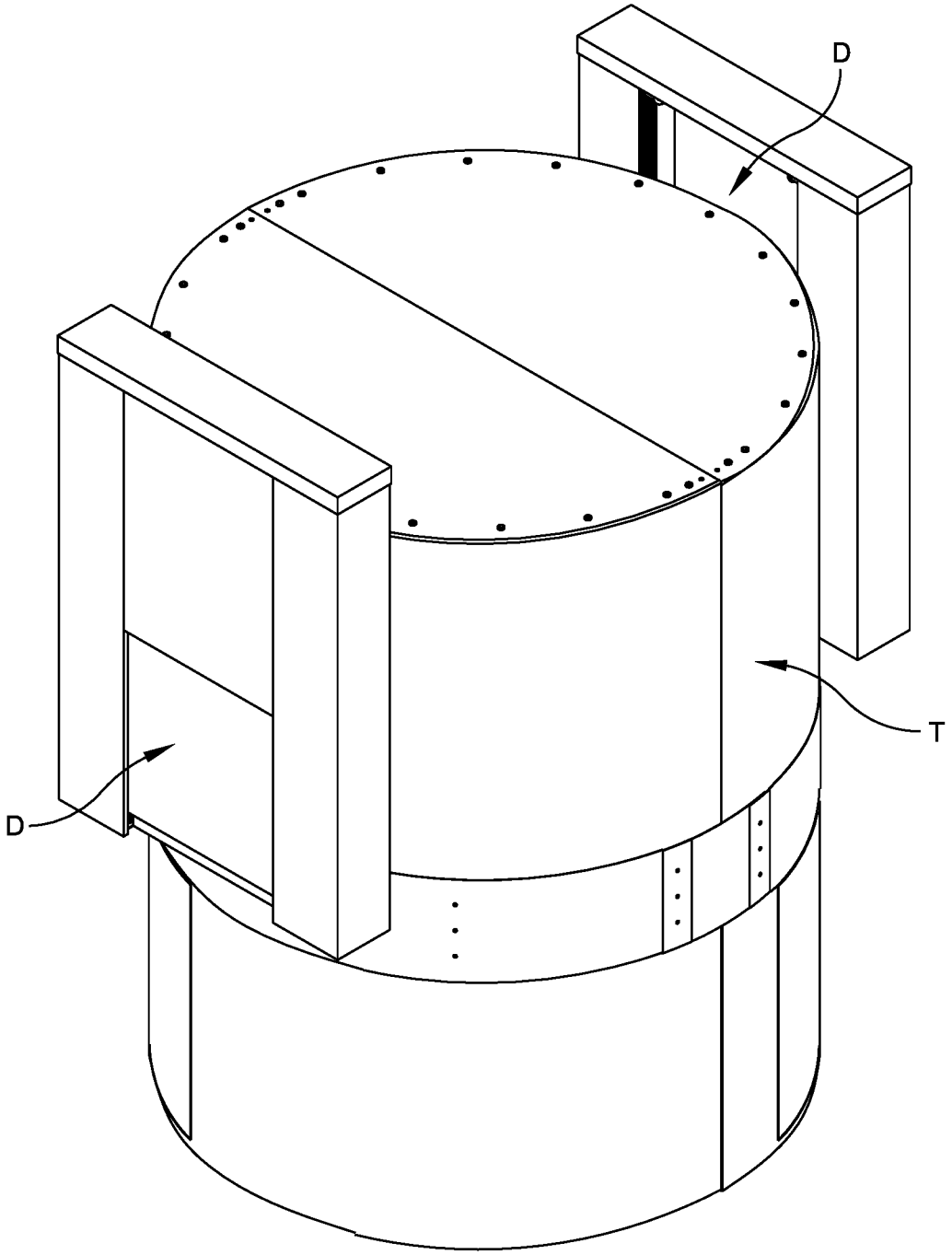
FIG. 1 is a perspective view of a system of the present invention.
Figure 2:
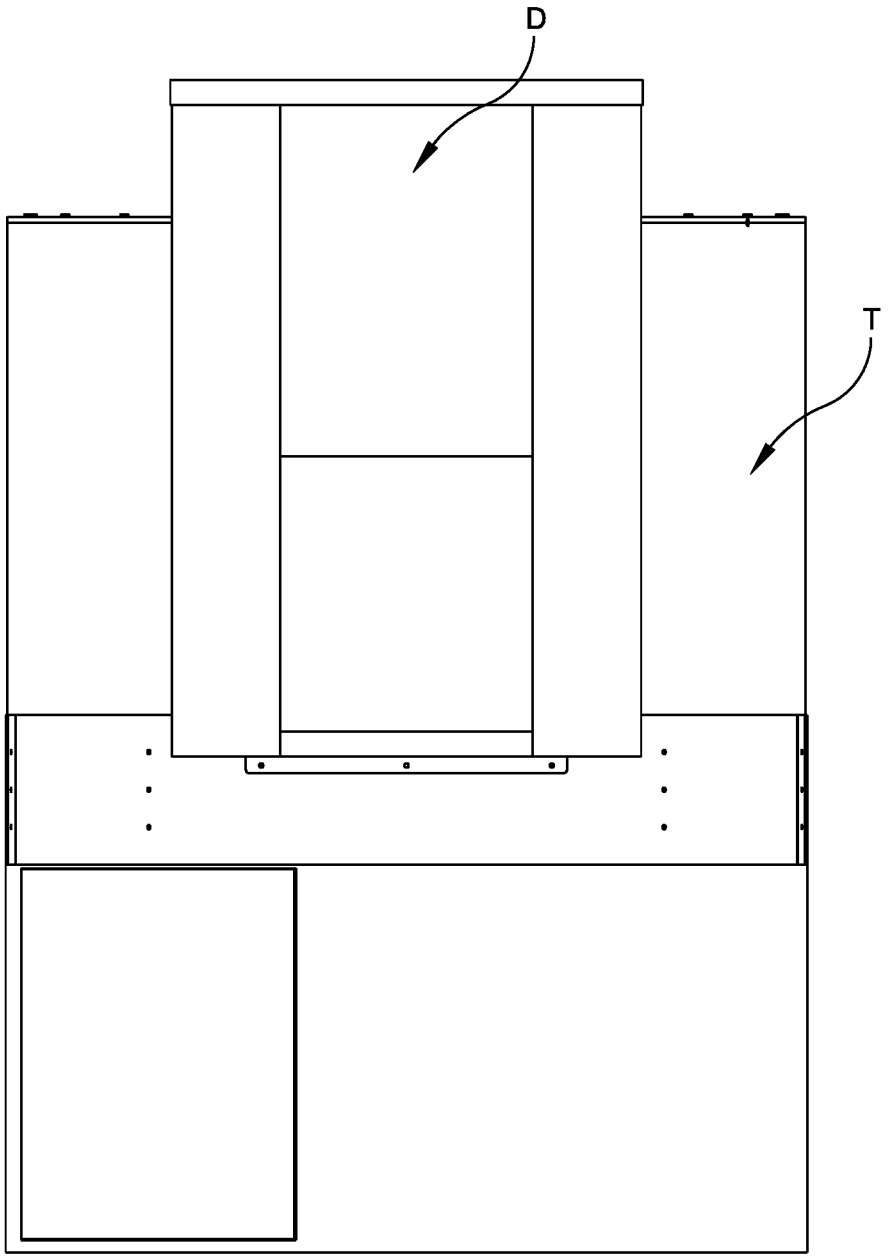
FIG. 2 is a front view of the system of FIG. 1 as taken at either the unsecured or secured window where the food product is either supplied or delivered.
Figure 3:
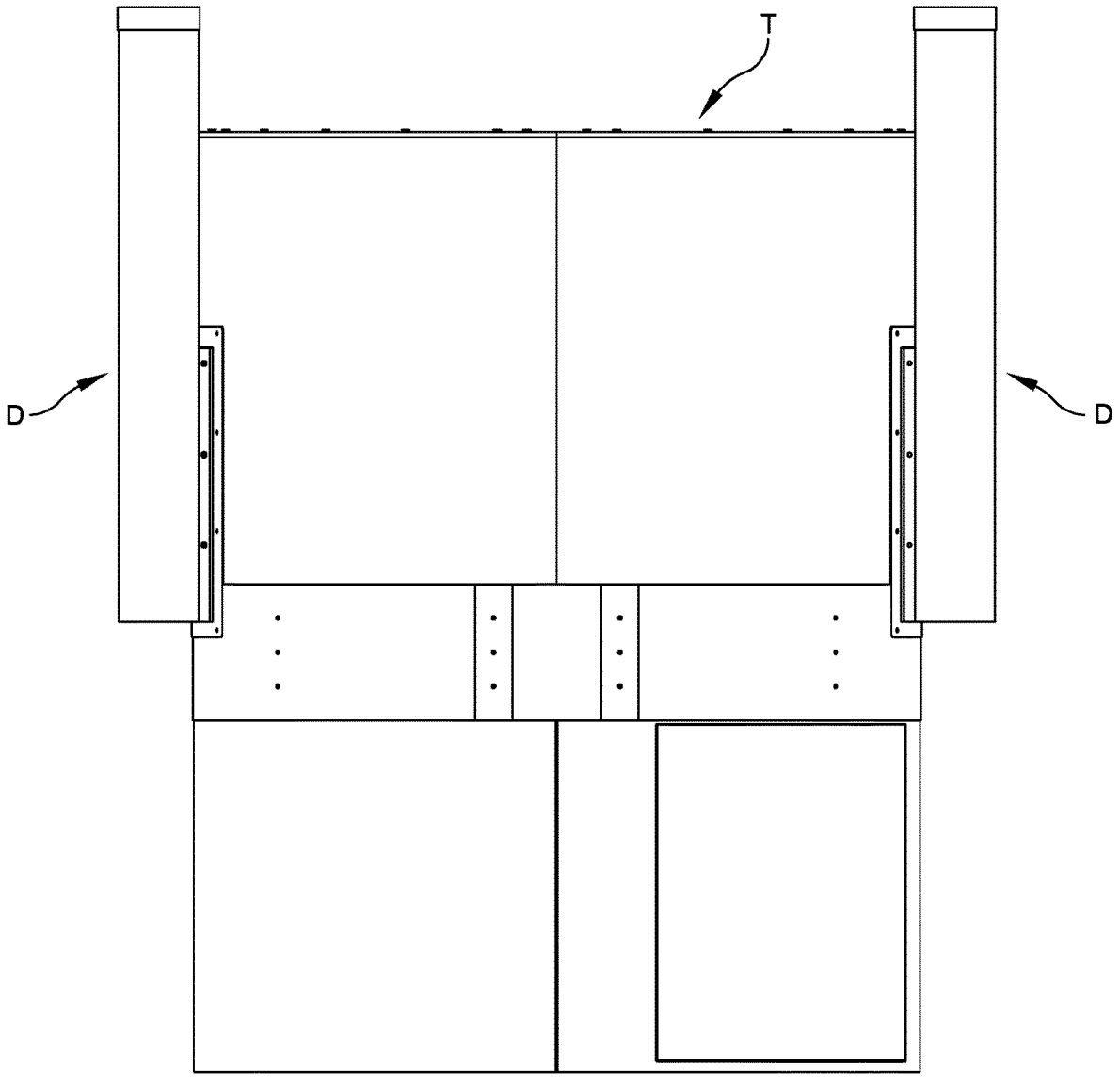
FIG. 3 is a side elevation view of the system illustrated in FIGS. 1 and 2.
Figure 4:
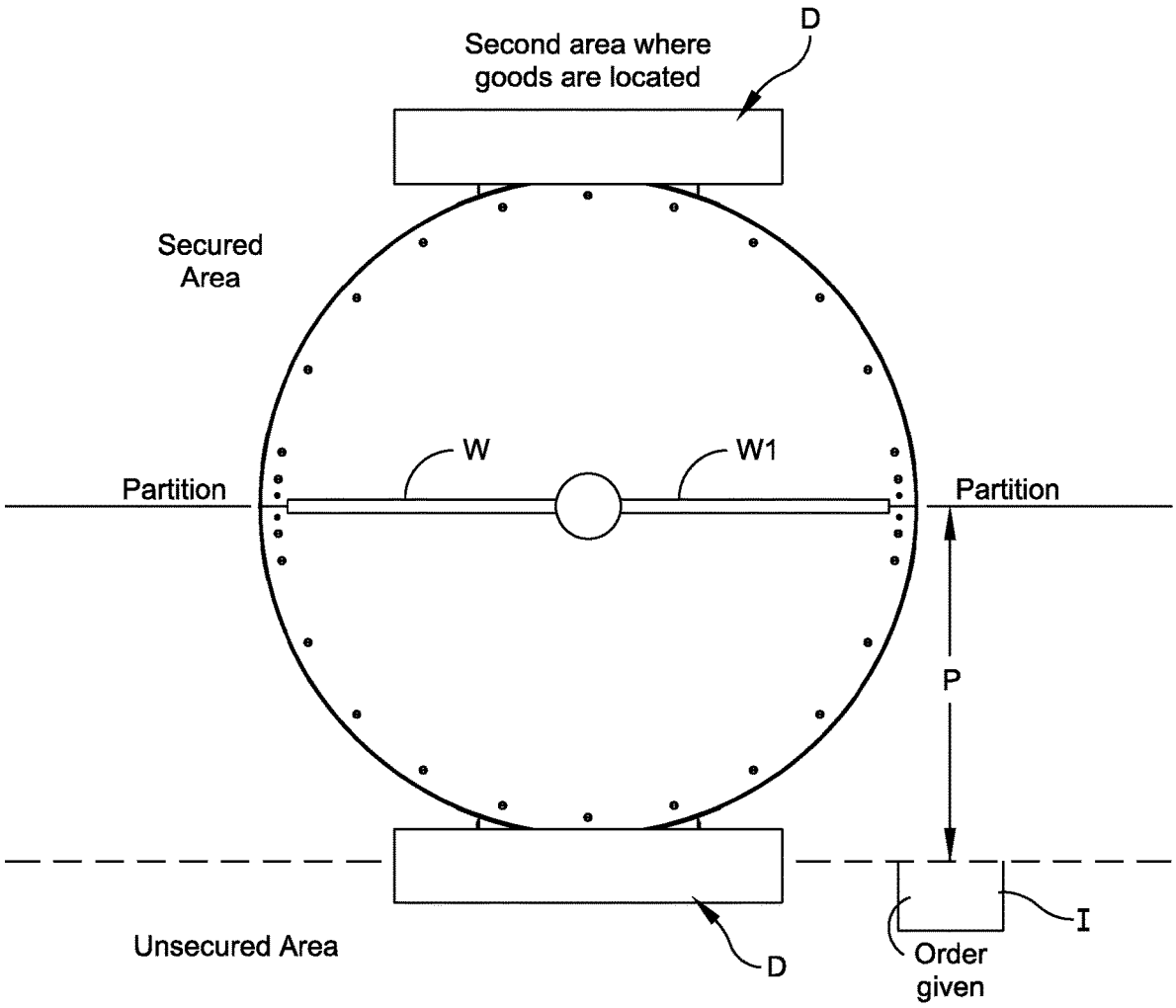
FIG. 4 may be considered as a plan view of the system illustrated in FIGS. 1-3.
Figure 5:
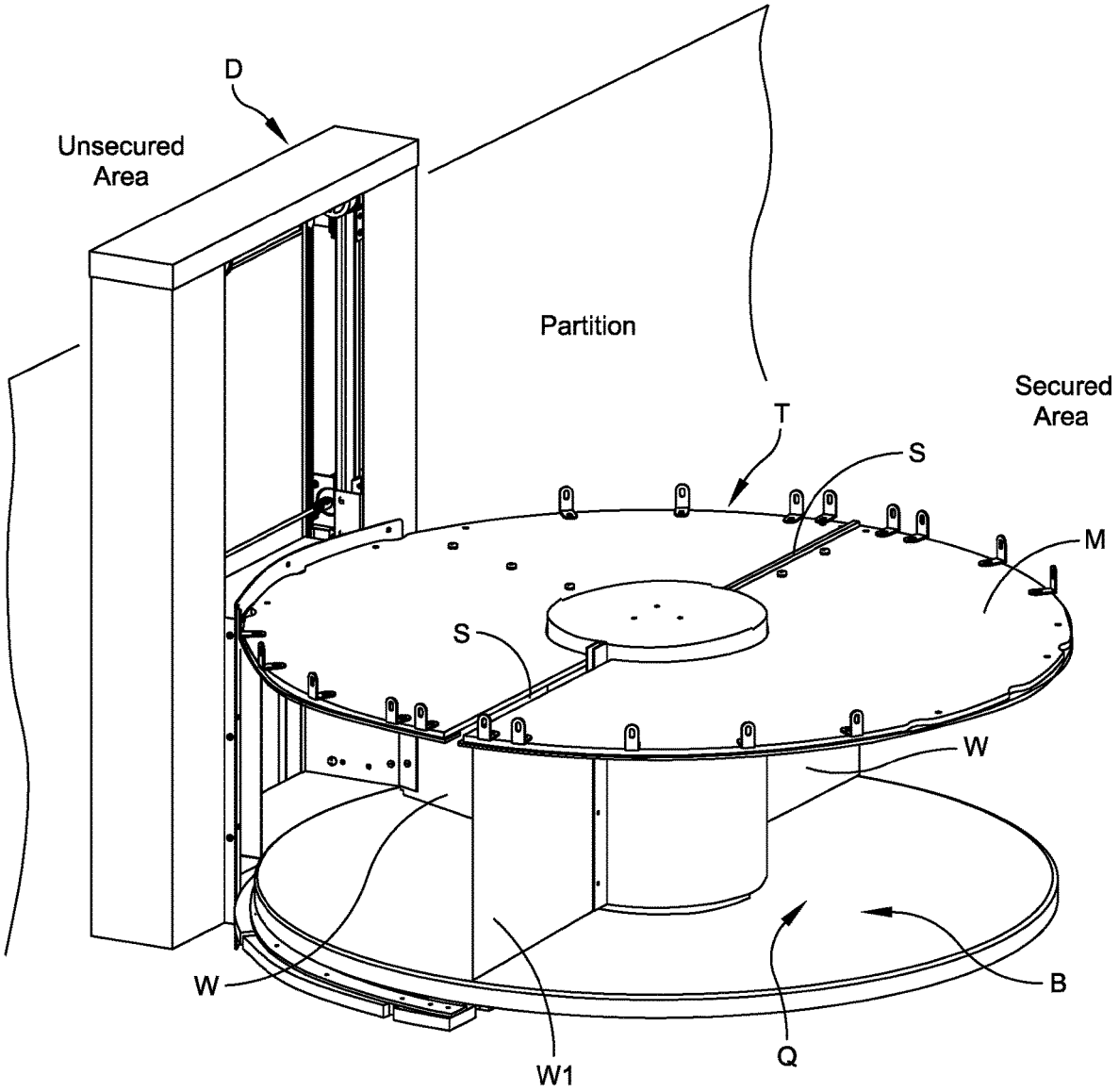
FIG. 5 is a perspective view showing some further detail of the turntable with one of the two access doors.

The facility that is delivering food products is provided with some type of a separation wall that is disposed between secured and unsecured areas. This wall is schematically illustrated in FIG. 4 by the partition P. The partition wall may be arranged at the middle of the turntable (FIG. 4) but is preferably provided adjacent to the door W at the unsecured area (FIG. 5).

In accordance with the system of the present invention the turntable may be considered as a part of this separation or partition wall. Then, by means of an intercom device or a touchpad, a customer can place an order at the unsecured side. Refer to such an input device I shown in FIGS. 4A-4D, as well as in FIG. 8. The item being ordered is then mounted on the turntable at the secured side. The turntable is rotated (see the rotation arrow R in FIG. 4C) so that the item can then be delivered from the secured side to the unsecured side. The turntable T preferably rotates in only one direction and in particular the base B of the turntable is the main rotating part of the turntable (see the base B in FIG. 5). As part of the turntable structure there is a divider wall W that may be made of a clear plexiglass. This wall W is also illustrated in FIG. 5 and may be provided in separate sections. If either of the doors D are open, then this divider wall W is in position; in a blocking position that blocks the internal annular passage Q that is defined over the base B. This blocking wall, when in place, prevents any contact or exchange of any kind between the secured and unsecured areas. If either of the doors D1 or D2 are open the blocking wall is in place providing a blocked past between the doors; blocking the entire interior annular passage Q.

After an item is placed on the turntable and both of the doors D are closed, some type of an actuation device J may be used at the secured side. This may be in the form of a button or other device that signals that the turntable can now be initiated for a rotation action to deliver the item from the secured to the unsecured side. In one embodiment the mere closing of both doors can initiate a turntable rotation. However, in a preferred embodiment, in addition a second input device J is actuated to initiate the rotation of the turntable base B. In order to providing this blocking action, one of the walls W, such as the wall shown as W1 in FIG. 5 is moved out of the way and the turntable moves in that direction stopping at the opposite door D2. This divider wall W1 is only temporarily lifted or moved out the way to enable the item to be delivered from one side of the turntable to the other side. Once the turntable has moved through usually 180 degrees, before either of the doors D are allowed to open, the dividing plexiglass wall W1 is lowered thus blocking any access through the turntable. Once the securing wall W1 is in position, then the door at the unsecured side can be opened and the customer is able to retrieve their purchase. Thus, it is preferred that, as soon as the rotation to the unsecured side takes place, the protective wall W1 is in place providing a blockage of the passage Q; this event occurring even before the door at the unsecured side is opened.

The security of the system is such that the plexiglass wall arrangement prohibits any return of any items, including possibly dangerous items. All purchases may be either through credit card, gift card or through an "app" on a telephone. No cash is used, as the turntable allows nothing to come from the unsecured side to the secured side.

The diagram of FIG. 5 shows a top member M of the turntable that may be fixed in position and has a slots at S where the wall W1 may be moved in and out. One of the walls is preferably fixed in position while the other wall is the one that can be moved out of the way in order for the item to be delivered from the secured side to the unsecured side. In the illustrated embodiment the partial dividing wall W1 is moved out of the way through slot S by a lifting action. After the turntable has been rotated it is then again lowered to maintain security. Another embodiment of the present invention is that the wall structure W can be operated between open and closed positions in a variety of other ways. For example, rather than lifting the wall it can be dropped down or can be collapsed in other ways to either block the passage Q or unblock the passage Q. In addition to a lifting action other mechanisms may be used to implement the action of the blocking wall. As far as the door D is concerned this also can take on many different forms in which the door or window is either open to provide access to the turntable or closed to inhibit access to the turntable.

Figure 4A:
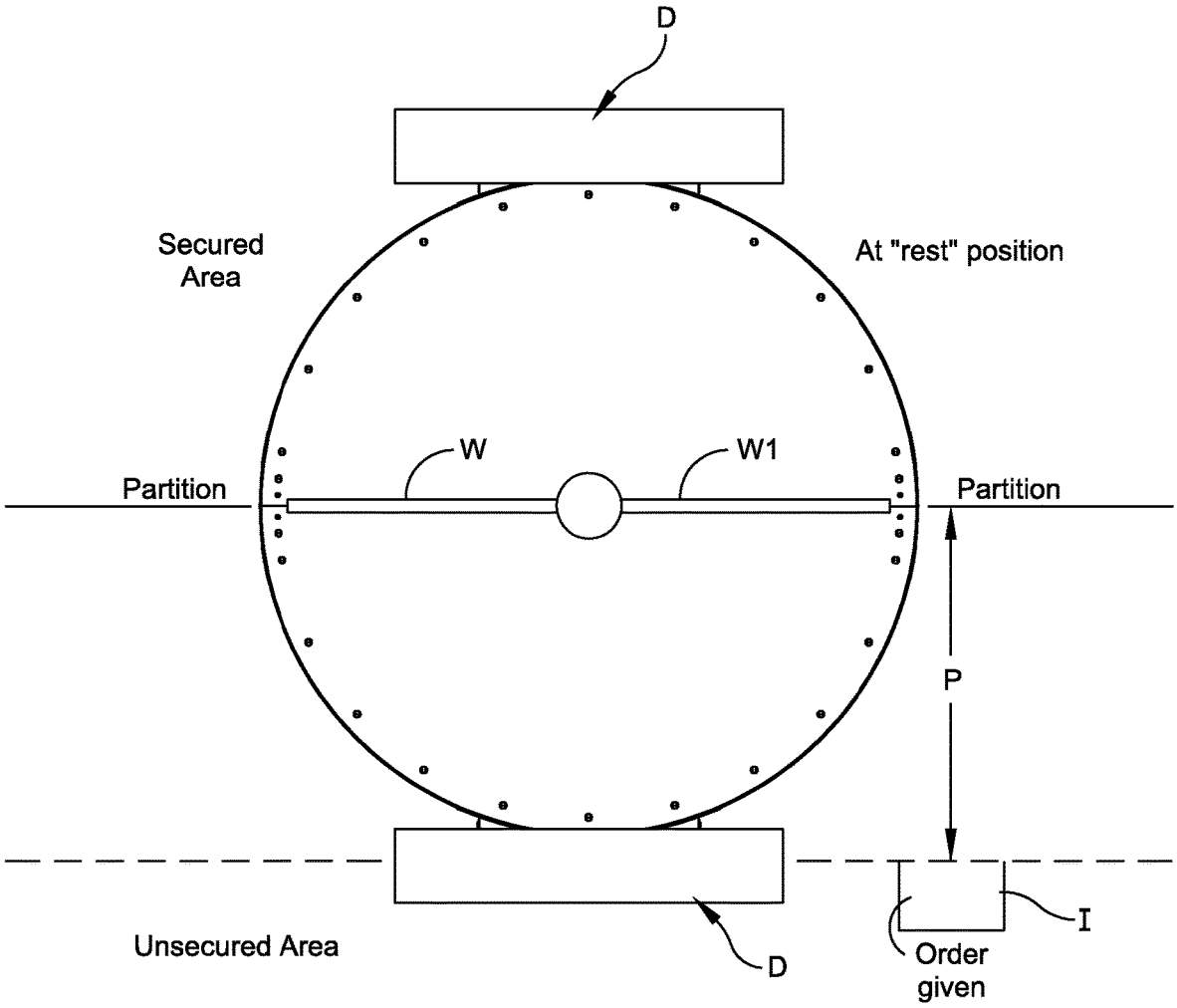
FIG. 4A is a schematic diagram of a first step in the method of the present invention.

Reference is now made to FIGS. 4A-4D which describe a sequence of events pertaining to the ability of the present system to control the transfer of an item; particularly a food product from a secured area, via the turntable T, to the unsecured area. FIG. 4A may be considered as a basic position in which no orders have yet been provided at the unsecured area. This may be considered an "at rest" position in which both of the doors D are closed. In that position any of the blocking walls such as those shown in FIG. 5 are in place so that the interior annular support area Q is blocked preventing any access from the unsecured area to the secured area via the turntable T. This is represented in FIG. 4A by the walls W and W1 shown in solid outline. This solid outline is indicative of the walls being in a blocked position such as shown in FIG. 5.

Figure 4B:
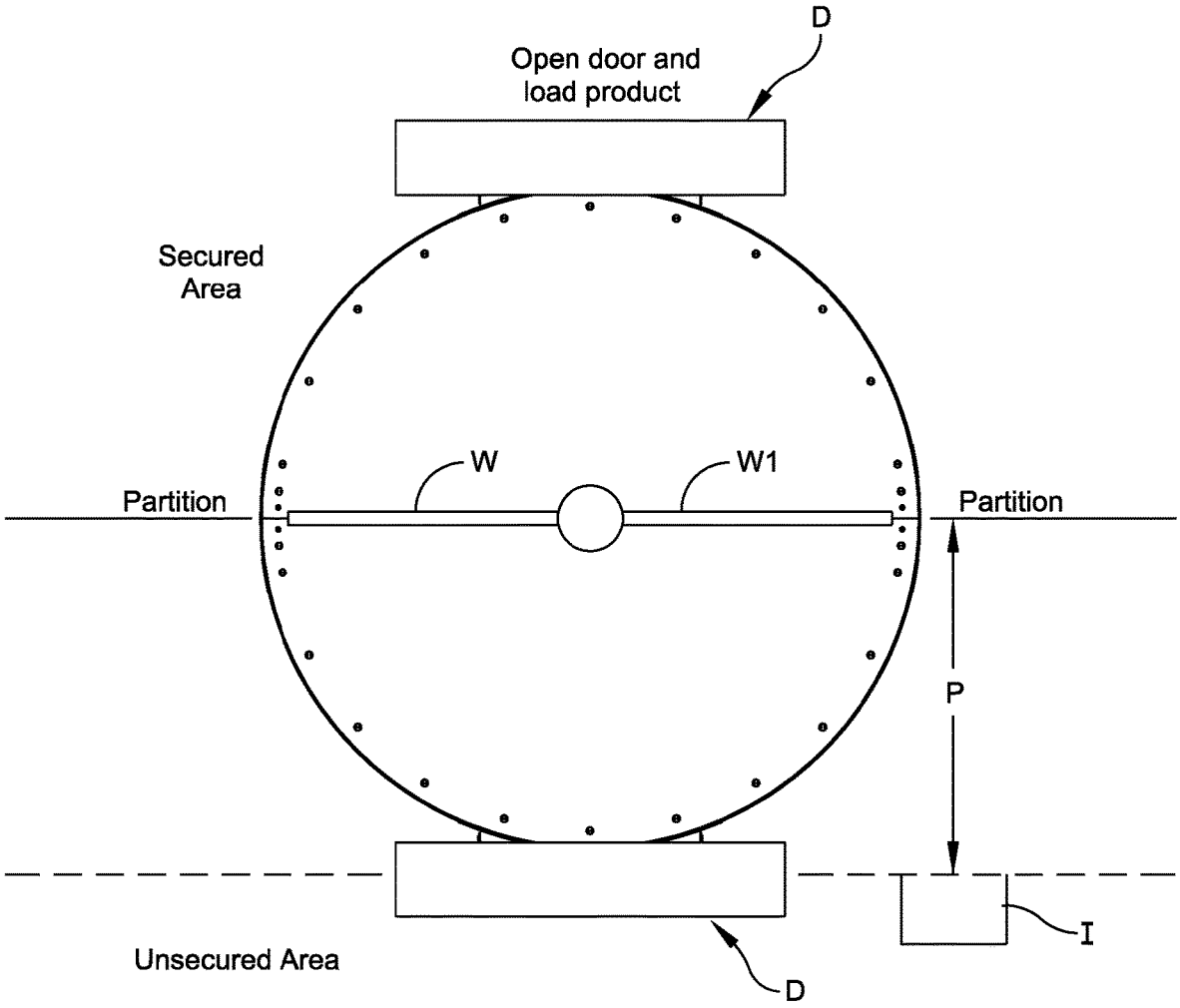
FIG. 4B is a schematic diagram of a second step in the method of the present invention.

Reference is now made to FIG. 4B that shows a further step in the method in that the door D at the secured area is now considered as being opened so that the food product can be loaded on to the turntable T. In the position illustrated in FIG. 4B, the door D in the unsecured area may be considered as closed. It is also noted that the input device I in both FIGS. 4A and 4B is situated in the unsecure area and is for the purpose of ordering an item to be delivered from the secure area. It is also noted in FIG. 4B that the blocking walls W and W1 are still in place in a "blocked" position.

Figure 4C:
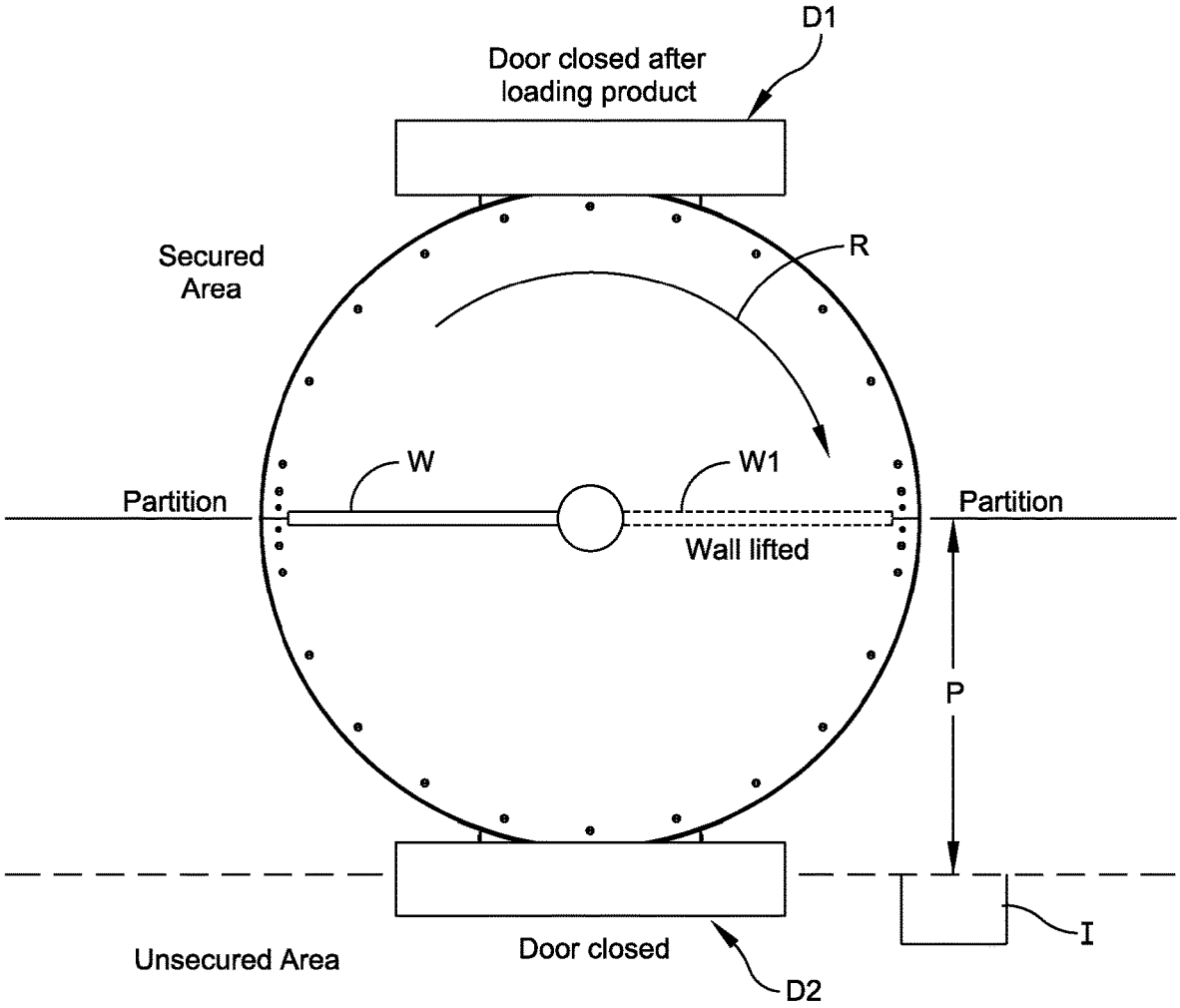
FIG. 4C is a schematic diagram of a third step in the method of the present invention.

Reference is now made to a further step in the method illustrated in FIG. 4C wherein the input door D1 in the secured area now closes. In the position in FIG. 4C the output door D2 is also closed. Once both of the doors D are closed, then a signal from the controller K initiates a rotation action in which the base B of the turntable is rotated in the direction of arrow R illustrated in FIG. 4C. Concurrent with this rotation is a lifting of the wall W1 so that the turntable T no longer blocks the path for the food item being delivered from the secured area to the unsecured area. The item being moved by the turntable will stop at the output door D2.

Figure 4D:
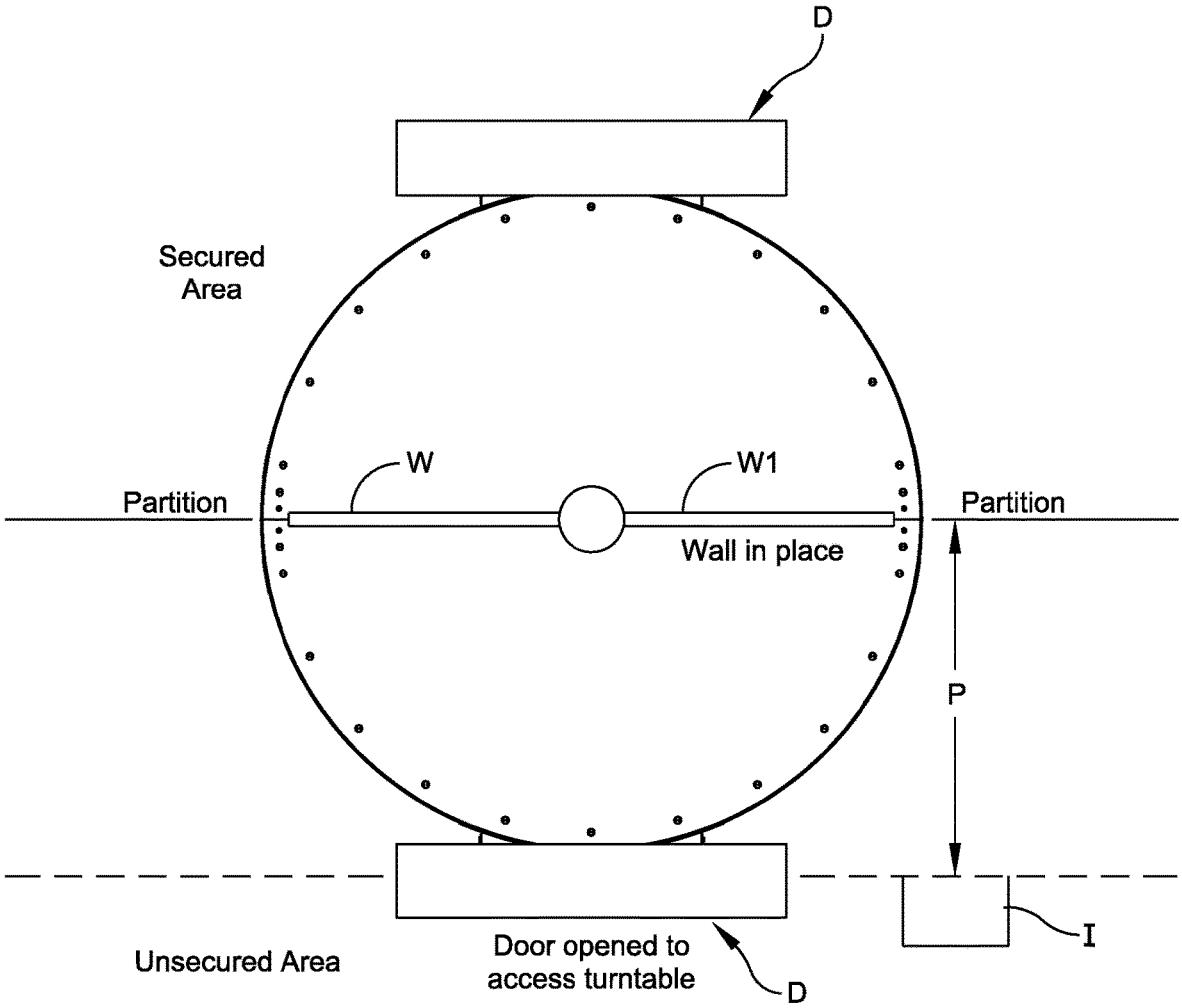
FIG. 4D is a schematic diagram of a fourth step in the method of the present invention.

Reference is now made to a further step in the method of the invention illustrated in FIG. 4D. In this position, the output door D2 is then opened to enable access to the turntable T. However, before the output door D2 is allowed to be opened, the blocking wall W1 is in place. This is desired in that before the output door D2 is opened one wants to make sure that there is no path through the turntable.

Figure 6:
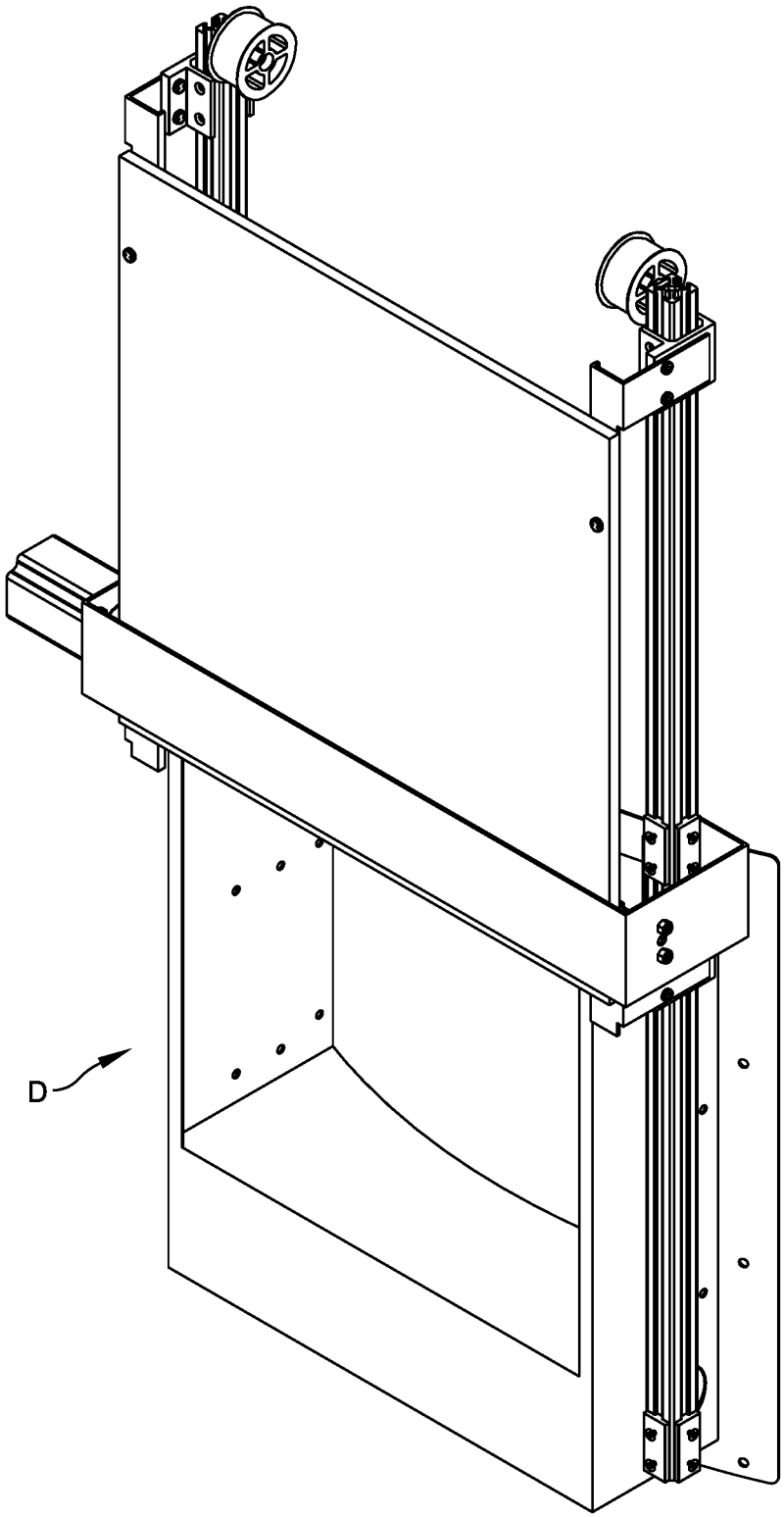
FIG. 6 is a perspective view of some further detail of the window structure.
Figure 7:
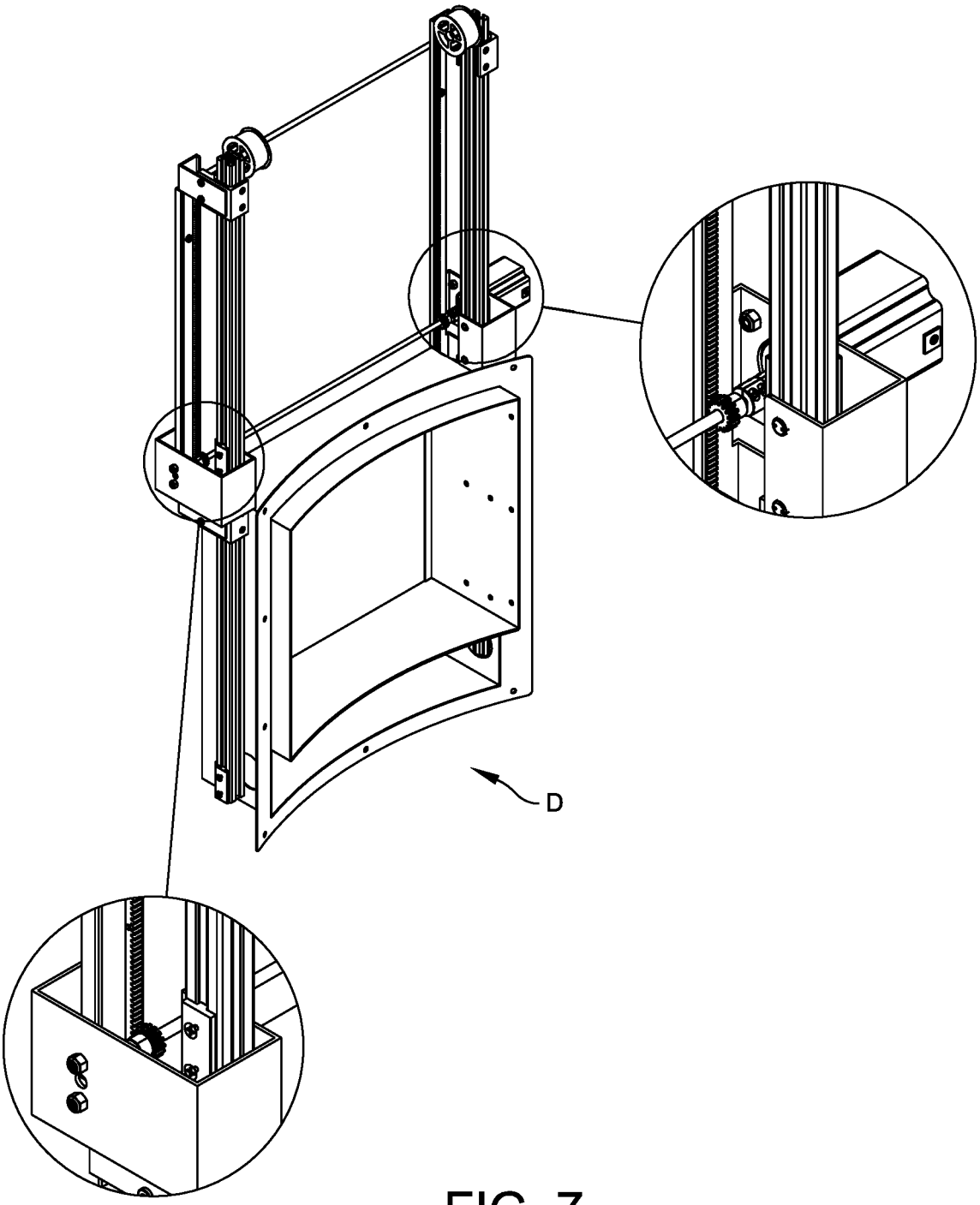
FIG. 7 illustrates some further details of a window structure.

As indicated previously, FIGS. 6 and 7 show specific mechanisms that can be used for opening or closing either of the doors D. In this regard, any number of different mechanisms are contemplated as falling under the scope of the present invention where the door, or even a window arrangement, can be opened and closed and appropriate signals are coupled to a controller to indicate the status of the doors D; either open or closed.

Figure 8:
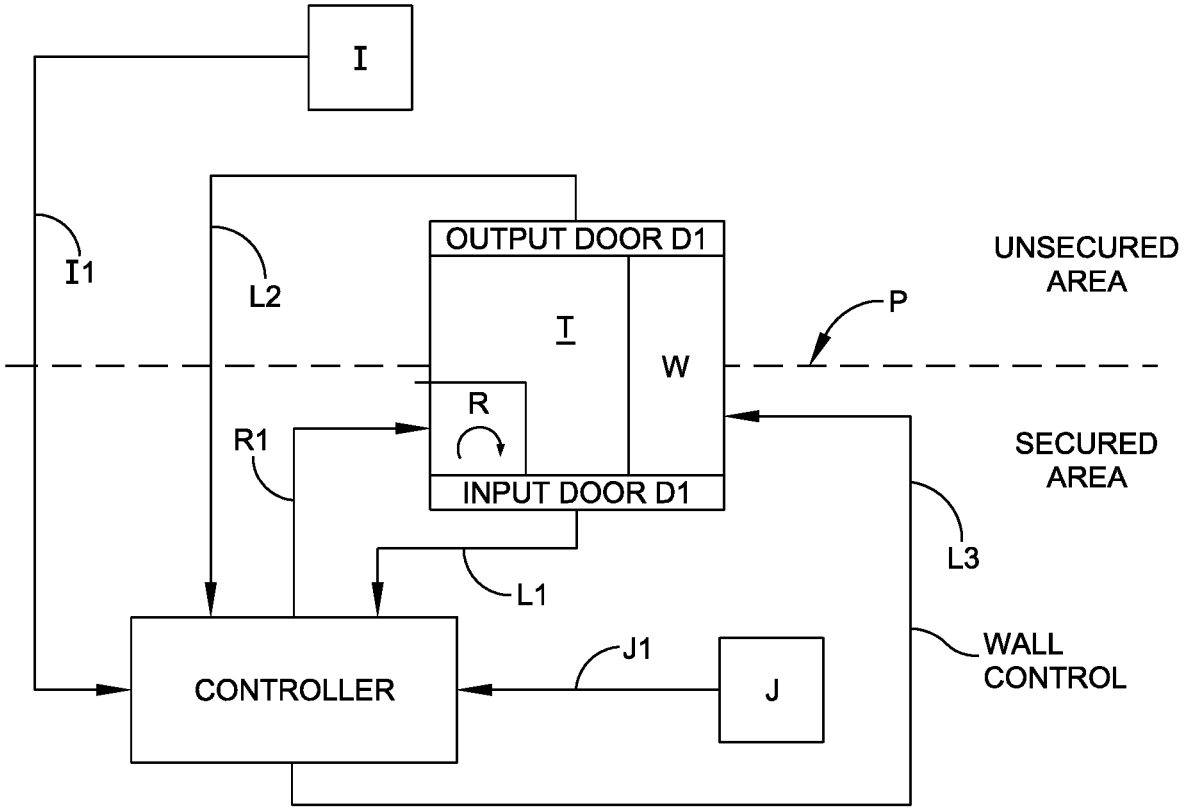
FIG. 8 is a control diagram associated with the turntable.

Reference is now made to the block diagram of FIG. 8 that illustrates the various components and control lines that are used in performing the various steps in the method of the present invention. Thus, in FIG. 8, there is shown an unsecured area and a secured area demarcated by the partition P. In this particular embodiment, the turntable T is illustrated as disposed at this partition wall, although the arrangement of FIG. 5 for the partition wall may also be employed.

In FIG. 8 the main center block is represented by the turntable T, an input door D1 at the secured area and an output door D2 at the unsecured area. This block also includes the wall W and a rotation block at R. In the diagram of FIG. 8, there may be considered a couple of input devices including a first input device I at the unsecured area that is used to make a request for the purchase of an item. In FIG. 8 refer to the control line I1 coupling from the first input device I to the controller K.

FIG. 8 also illustrates a second input device J at the secured area which may be used to instruct the controller K to rotate the base of the turntable T in delivering the item, via the turntable base B, from the input door to the output door. In one embodiment, logic gating may be provided in the controller K so that the signals on lines L1 and L2 must indicate a closed position of the respective doors and a furthermore signal is provided on line J1 from the second input device J to the same logic. In that way, the rotation via line R1 to the turntable can only occur when both of the doors D1 and D2 are closed and an input signal is received from the input device J. In an alternate embodiment of the present invention, the signal on line R1 may be provided only on the basis of the input and output doors being closed without the use of an input device J. The line R1 from the controller K simply controls the rotation of the base of the turntable.

Having now described a limited number of embodiments of the present invention, it should now be apparent to those skilled in the art that numerous other embodiments and modifications thereof are contemplated as falling within the scope of the present invention, as defined by the appended claims. For example, the drawings illustrate the rotation at the turntable by a rotation arrow R that is clockwise. In an alternate embodiment of the invention, the turntable T can be also operated to rotate in a counterclockwise direction. In that case, the movable blocking wall would be on the opposite side to that illustrated in FIGS. 4A-4C.

What is claimed is:

1. A turntable system for use between a secured area and an unsecured area of a facility in which the turntable system is comprised of a turntable having a base and interior support area, an input door connected to the turntable at the secured area where items can be loaded through the input door and an output door connected to the turntable at the unsecured area and at a location disposed away from the input door where the items are received via said output door at the unsecured area, the turntable system further including at least one blocking wall that is disposed within the interior support area of the turntable and, at least a portion of which, is moveable from a blocked position to an unblocked position as the base of the turntable is rotated in delivering the items from the input door to the output door.

2. The turntable system of claim 1 wherein the turntable also includes a top that has a slot for receiving the at least one blocking wall to enable the blocking wall to selectively block and unblock the interior support area of the turntable.

3. The turntable system of claim 2 wherein there are provided multiple blocking walls disposed within the interior support area of the turntable.

4. The turntable system of claim 3 wherein one of the blocking walls is in a fixed position and another of the blocking walls is movable between the blocked and unblocked positions.

5. The turntable system of claim 1 including an input device at the unsecured area used to make a request for the purchase of the item, a controller for directing the request from the input device to the secured area, a second input device at the secured area to instruct the controller to rotate the base in delivering the items from the input door to the output door.

6. The turntable system of claim 5 wherein each of the input door and the output door has a closed position, and wherein the controller operates the rotation of the turntable base only when both of the input and output doors are closed.

7. A turntable system for use between a secured area and an unsecured area of a facility in which the turntable system is adapted to transfer an item in a secure manner from the secured area to the unsecured area, said turntable system comprised of:

a turntable having a base and interior annular support area;

an input door connected to the turntable at the secured area where the item can be loaded through the input door, and having open and closed positions;

an output door connected to the turntable at the unsecured area and at a location opposite the input door where the items are received via said output door at the unsecured area, and having open and closed positions;

at least one blocking wall that is disposed within the interior support area of the turntable and having blocked and unblocked positions;

and a controller for controlling a rotation of the base in delivering the item from the input door to the output door;

said controller further adapted to control the at least one blocking wall to be in the unblocked position only when both of the input and output doors is in the closed position.

8. The turntable system of claim 7 wherein the turntable also includes a top that has a slot for receiving the at least one blocking wall to enable the blocking wall to selectively block and unblock the interior support area of the turntable.

9. The turntable system of claim 7 including a first input device at the unsecured area used to make a request for the purchase of the item, said controller for directing the request from the input device to the secured area, a second input device at the secured area to instruct the controller to rotate the base in delivering the items from the input door to the output door.

10. The turntable system of claim 9 wherein the first input device comprises a touch pad at which one can order an item, and the second input device comprises an actuation button or switch that initiates the rotation of the base of the turntable.

11. The turntable system of claim 10 wherein the rotation of the base of the turntable occurs only when both the second input device is operated and both of the input and output doors are closed.

12. The turntable system of claim 11 wherein the controller allows the rotation of the base of the turntable to occur only when the at least one blocking wall is in the unblocked position.

13. The turntable system of claim 7 wherein there are provided multiple Hocking walls disposed within the interior support area of the turntable.

14. The turntable system of claim 13 wherein one of the blocking walls is in a fixed position and another of the blocking walls is movable between blocked and unblocked positions.

15. A method of controlling a turntable system for use between a secured area and an unsecured area of a facility in which the turntable system is adapted to transfer an item in a secure manner from the secured area to the unsecured area, said method of controlling a turntable system comprised of:

providing a turntable having a base and interior annular support area;

disposing an input door connected to the turntable at the secured area where the item can be loaded through the input door, and having open and closed positions;

disposing an output door connected to the turntable at the unsecured area and at a location opposite the input door where the items are received via said output door at the unsecured area, and having open and closed positions;

providing at least one blocking wall that is disposed within the interior support area of the turntable and having blocked and unblocked positions;

and controlling a rotation of the base in delivering the item from the input door to the output door by controlling the at least one blocking wall to be in the unblocked position only when both of the input and output doors are in their respective closed positions.

16. The method of claim 15 wherein the turntable also includes a top that has a slot for receiving the at least one blocking wall to enable the blocking wall to selectively block and unblock the interior support area of the turntable.

17. The method of claim 15 including providing a first input device at the unsecured area used to make a request for the purchase of the item, said controller directing the request from the input device to the secured area, providing a second input device at the secured area to instruct the controller to rotate the base in delivering the items from the input door to the output door.

18. The method of claim 17 including providing the first input device as a touch pad at Which one can order an item, and providing the second input device as an actuation button or switch that initiates the rotation of the base of the turntable.

19. The method of claim 18 wherein the rotation of the base of the turntable occurs only when both the second input device is operated and both of the input and output doors are closed.

20. The method of claim 19 wherein the controller allows the rotation of the base of the turntable to occur only when the at least one blocking wall is in the unblocked position.

* * * * *